United States Patent [19]

Musto

[11] Patent Number: 4,746,892

[45] Date of Patent: May 24, 1988

[54] THERMALLY ACTUATED LATCH FOR ELECTRICAL CIRCUITS

[75] Inventor: Keith M. Musto, Warwick, R.I.

[73] Assignee: Elmwood Sensors, Inc., Pawtucket, R.I.

[21] Appl. No.: 40,569

[22] Filed: Apr. 17, 1987

[51] Int. Cl.[4] ..... H01H 37/76

[52] U.S. Cl. ..... 337/403; 337/404

[58] Field of Search ..... 337/401–413

[56] References Cited

U.S. PATENT DOCUMENTS

| | | | |
|---|---|---|---|
| 1,181,705 | 5/1916 | Weber | 337/411 |
| 3,201,549 | 8/1965 | Lowe | 337/407 |
| 3,602,864 | 8/1971 | Burney | 337/407 |
| 4,472,705 | 9/1984 | Carlson | 337/299 |

*Primary Examiner*—H. Broome

*Attorney, Agent, or Firm*—Salter & Michaelson

[57] ABSTRACT

A thermally actuated latch for electrical circuits is permanently operative for completing an electrical circuit upon exposure to a predetermined elevated temperature. The latch includes a fixed contact, a movable contact arm which is biased toward the fixed contact, a movable contact on the movable contact arm, and a deformable pellet. The deformable pellet communicates with the movable contact arm through a communicator disc to normally maintain the movable contact in spaced relation with the fixed contact. The pellet is deformable to a disposition of reduced profile upon exposure to a predetermined elevated temperature to allow the movable contact to be resiliently moved into engagement with the fixed contact in order to complete an electrical circuit connected to the latch.

8 Claims, 2 Drawing Sheets

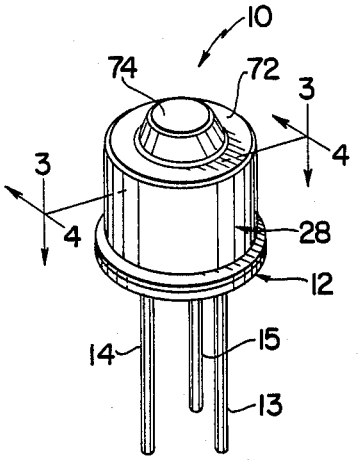
FIG. 1
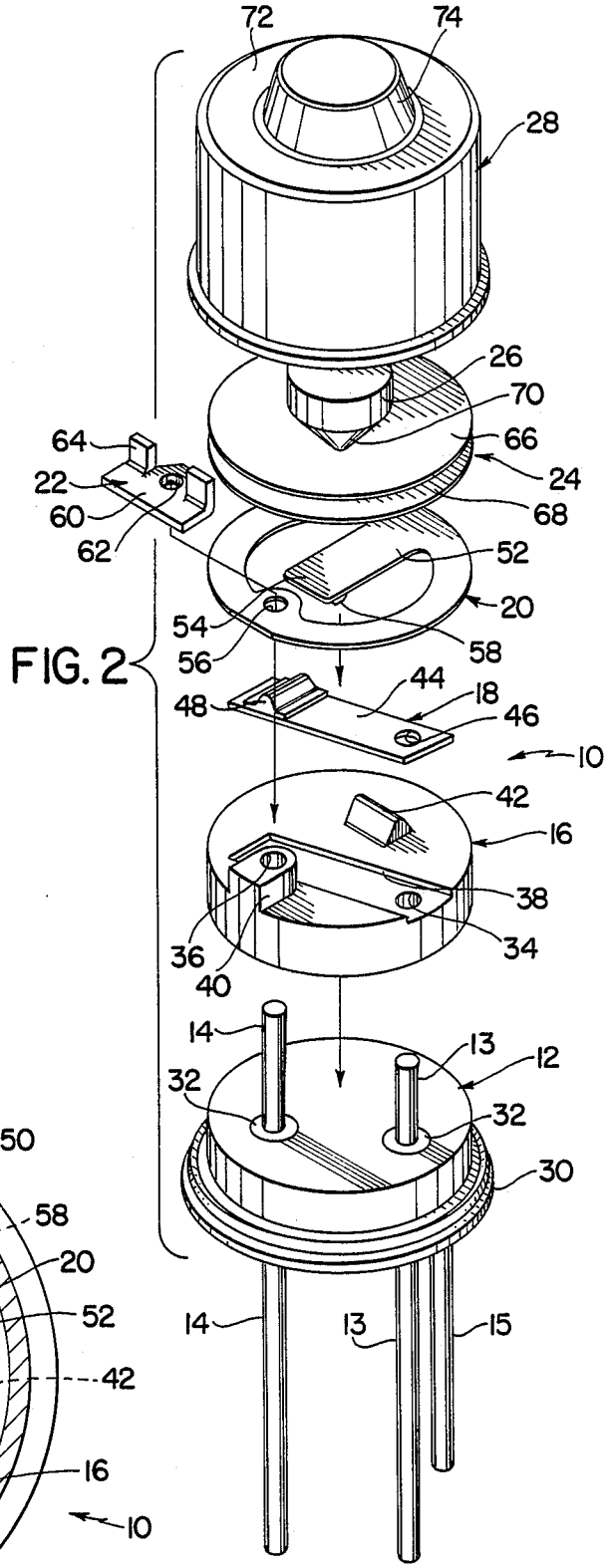
FIG. 2
FIG. 3
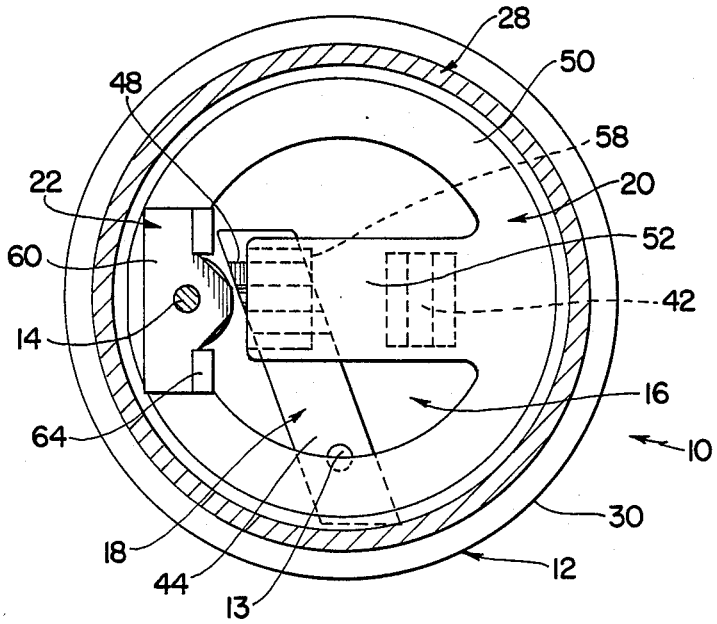

THERMALLY ACTUATED LATCH FOR ELECTRICAL CIRCUITS

BACKGROUND AND SUMMARY OF THE INVENTION

The instant invention relates to thermally actuated switching devices and more particularly to a thermally actuated latch which is permanently actuatable for completing an electrical circuit in response to exposure to a predetermined elevated temperature condition.

A variety of different types of devices which are actuatable in response to predetermined elevated temperature conditions have been heretofore available. For example, the U.S. Pat. Nos. 4,065,741 to Sakamoto, 3,952,274 Plasko; 3,956,725 Merrill et al; 3,291,945 Merrill et al; 4,145,654 Grimm; 4,186,366; McVey 4,307,370 Hollweck; and 4,472,705 to Carlson, and the European patent application No. 80300246.8, to Eaton disclose devices which represent the closest prior art to the subject invention of which the applicant is aware and which are fusible in response to predetermined elevated temperature conditions for interrupting electrical circuits. Devices of the type disclosed in these references have generally been found to be effective for interrupting various circuits in order to alleviate high-temperature overload conditions. However, while the above devices have been found to be effective, they have not been operative for closing circuits in response to elevated temperature conditions. Further, it has been found that there is a significant need for an effective device for permanently closing various electrical circuits in response to high-temperature conditions. For example, it has been found that there is a need for an effective device for permanently actuating audible and/or visible alarms and other indicator devices in order to alert operators to the fact that high-temperature overload conditions either exist or have existed and that certain other circuitry components may therefore require replacement. It has also been found that there is a need for an effective device for closing circuits in order to actuate various personnel and/or equipment protection systems, including fireprotection systems and fire door opening mechanisms, in response to high-temperature conditions. In this regard, while conventional thermostatic switching devices have been heretofore available for closing circuits in response to high-temperature conditions, it has been found that there is nevertheless a need for a positively and permanently actuatable device for closing circuits in response to various predetermined high-temperature conditions.

The instant invention provides an effective device which is permanently actuatable for closing electrical circuits in response to predetermined high-temperature conditions. More specifically, the instant invention provides a thermally actuated latch comprising a base portion, a fixed contact on the base portion, a resiliently movable contact arm having a movable contact thereon which is resiliently biased to a position wherein it engages the fixed contact, and deformable means communicating with the contact arm to normally maintain the movable contact in spaced relation to the fixed contact. The deformable means, preferably comprises a fusible pellet, and it is deformable upon exposure to a predetermined elevated temperature to enable the movable contact to move to a position of engagement with the fixed contact. The thermally actuated latch preferably further comprises a housing having a wall portion, a communicator disc in the housing, and a fulcrum on the base portion; and the fusible pellet is preferably mounted in the housing adjacent the wall portion. Specifically, the fusible pellet is preferably mounted so that it communicates with the movable contact arm through the communicator disc for normally maintaining the movable contact arm in a position wherein it is pivoted on the fulcrum to maintain the movable contact in spaced relation to the fixed contact. The communicator disc is preferably mounted in the housing so that it is also operative for substantially isolating the deformable means from the spaced and movable contacts to prevent the deformable means from interfering with the engagement of the fixed and movable contacts in the event that the fusible pellet is fragmented or partially melted before the movable contact is moved into engagement with the fixed contact. The movable contact arm is preferably embodied as an integrally struck portion of an actuator disc comprising a peripheral rim portion and the movable arm, and the arm preferably extends substantially radially inwardly from the rim portion. Further, the communicator disc preferably communicates with the rim portion of the actuator disc adjacent the end of the movable arm for normally maintaining the movable arm in a position wherein it is pivoted on the fulcrum to maintain the movable contact in spaced relation to the fixed contact.

The thermally actuated latch of the subject invention effectively solves the problem of providing a reliable latching device which is permanently actuatable for closing an electrical circuit in response to a high-temperature condition. Specifically, the communicator disc and the actuator disc cooperate for maintaining the fixed and movable contacts well spaced apart during normal operations. However, in the event of a high-temperature condition, the fusible pellet is deformable to a disposition of reduced profile to enable the movable contact to positively engage the fixed contact and to thereby close an electrical circuit connected to the latch. In this connection, the actuator disc, the communicator disc and the fulcrum cooperate to amplify the movement of the movable arm to normally maintain the movable contact in well spaced relation to the fixed contact in order to prevent arcing. Further, the communicator disc physically isolates the fusible pellet from both the movable and fixed contacts to insure that they are not contaminated before they are moved to a closed position.

Accordingly, it is a primary object of the instant invention to provide an effective and reliable latching device for closing an electrical circuit in response to a high-temperature condition.

Another object of the instant invention is to provide an effective permanently actuatable latching device for closing an electrical circuit in response to a high-temperature condition.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is a perspective view of the thermally actuated latch of the instant invention;

FIG. 2 is an exploded perspective view thereof;

FIG. 3 is a sectional view taken along line 3—3 in FIG. 1;

and

Figure 4:
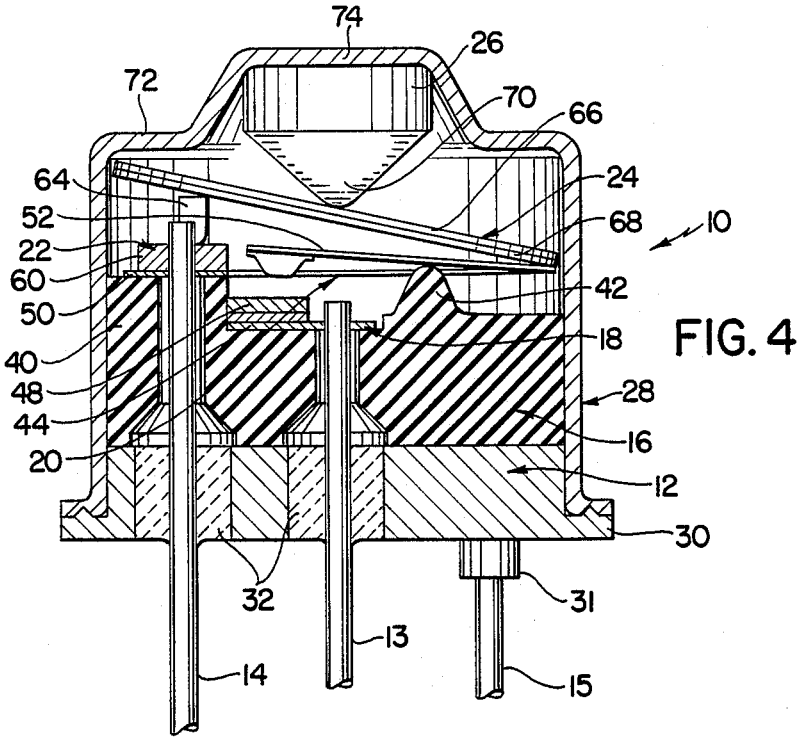
FIG. 4 is a sectional view taken along line 4—4 in FIG. 1.
Figure 5:
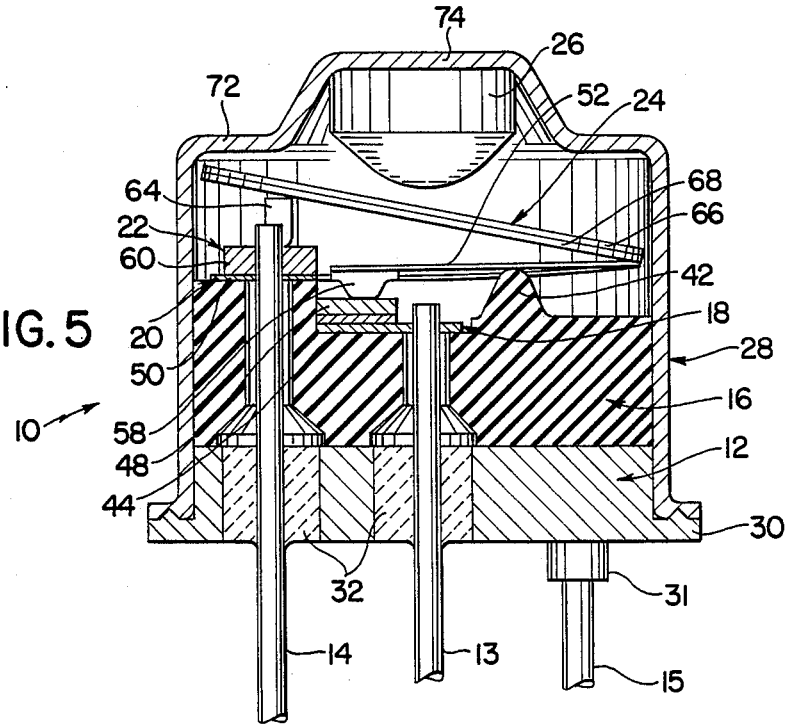

FIG. 5 is a similar sectional view with the latch in an actuated condition.

DESCRIPTION OF THE INVENTION

Referring now to the drawings, the thermally actuated latch of the instant invention is illustrated and generally indicated at 10 in FIGS. 1 through 5. The latch 10 comprises a header generally indicated at 12 having first, second and third terminal elements 13, 14 and 15, respectively, attached thereto, a base 16, a fixed contact assembly 18, an actuator disc assembly 20, a pivot element 22, a communicator disc assembly 24, a fusible pellet 26, and a can or housing 28. During operation of the latch 10, the fusible pellet 26 is deformable to a disposition of reduced profile to electrically connect the first and second terminals 13 and 14, respectively, in response to a predetermined elevated temperature condition.

The header 12 is preferably of substantially circular configuration, it is preferably made of a suitable electrically conductive material, such as steel, and it has a lower annular flange 30. The terminal elements 13, 14 and 15 are also made of an electrically conductive material, such as steel; and the terminal element 15 is secured and electrically connected to the header 12 with a metallic weld abutment 31, whereas the terminal elements 13 and 14 extend through the header 12, and are secured to the header 12 and electrically insulated therefrom by means of glass seals 32.

The base 16 is preferably made of a suitable electrical insulating material, such as a ceramic, in a substantially circular configuration. The base 16 is dimensioned to be received on the header 12, and it includes apertures 34 and 36 which are dimensioned and oriented for receiving the terminal elements 13 and 14 therethrough, respectively. Formed on the upper surface of the base 16, i.e., the surface which faces away from the header 12, is an elongated recess 38 which is dimensioned for receiving the fixed contact assembly 18 therein, and the aperture 34 extends through the recess 38 as illustrated. Also formed on the upper surface of the base 16 is a boss 40 through which the aperture 36 extends, and a raised fulcrum member 42.

The fixed contact assembly 18 comprises an electrically conductive metal band 44 having an aperture 46 therethrough adjacent one end thereof and a fixed contact 48 which is secured to the band 44 adjacent the opposite end thereof. The contact assembly 18 is received in the recess 38 in the base 16 so that the upper end of the terminal element 13 extends through the aperture 46. The strip 44 is secured to the upper portion of the terminal element 13 by resistance welding or soldering to electrically connect the terminal element 13 to the fixed contact 48 and to retain the contact assembly 18 in the recess 38.

The actuator disc 20 is preferably integrally struck or blanked from a resiliently deformable, electrically conductive metal; and it comprises a substantially circular peripheral ring or rim portion 50 and a movable contact arm 52 which extends substantially radially inwardly from the rim portion 20, terminating in a free terminal end 54. An aperture 56 is formed in the portion of the rim portion 50 which is closest to the terminal end 54, and a movable contact 58 is secured on the movable contact arm 52 adjacent the free terminal end 54. The actuator disc 20 is assembled in the latch 10 so that the terminal element 14 passes through the aperture 56 with the adjacent portion of the rim portion 50 resting on the boss 40. The disc 20 is further assembled and positioned on the base 16 so that the fulcrum element 42 engages the arm 52 adjacent the connected end thereof and so that the movable contact element 58 on the arm 52 is engageable with the fixed contact element 48.

The pivot element 22 is preferably formed of a suitable metal, such as steel, and it comprises a base portion 60 having an aperture 62 therein and a pair of spaced, upstanding fingers 64. The pivot element 22 is received on the upper end portion of the terminal element 14 to capture the actuator disc 20 between the pivot element 22 and the boss 40, and the pivot element 22 is secured and electrically connected to the terminal element 14 by suitable means, such as resistance welding or soldering.

The communicator disc assembly 24 comprises a substantially rigid disc 66 of substantially circular configuration and a substantially circular insulator disc 68 which is of substantially the same diameter as the disc 66 and made of an electrical insulating material. The insulator disc 68 is positioned so that one peripheral portion thereof rests on the upstanding fingers 64 and so that the opposite peripheral portion thereof engages the rim portion 50 of the actuator disc 20 adjacent the connected end of the movable arm 52, and the rigid disc 66 is positioned in substantially aligned relation on the insulator disc 68. It will be understood, however, that other embodiments of the disc assembly 24, such as those which include a single rigid disc made of an electrical insulating material, are contemplated.

The pellet 26 is made of a suitable material having a predetermined deformation point at which it is changed to a disposition of reduced profile for closing the contact elements 58 and 48 in order to electrically interconnect the terminal elements 13 and 14. The pellet 26 is preferably cylindrical in shape and includes a rounded conical tip portion 70, although it will be understood that the tip portion would also be of various other configurations such as rounded or flat. The tip portion 70 is preferably positioned in the can 28 so that the tip portion 70 communicates with the rigid disc 66 adjacent the center thereof to maintain the actuator disc 20 in a resiliently deformed position wherein the movable arm 52 is pivoted upwardly on the fulcrum element 42 to position the contact element 58 in spaced relation to the contact element 48. The pellet 70 may be made of any suitable organic substance, such as anhydrous pthalic acid, salicylic acid, levulose, and/or glucose or a suitable metal or metal alloy, such as tin, bismuth, cadmium, lead or zinc, depending on the desired deformation temperature. In any event, the pellet 26 is made of a material which deforms, such as by shrinking, melting, fusing or fragmenting, at a predetermined elevated deformation temperature so that it is changed from an initial configuration such as the one illustrated in the drawings to a disposition of reduced profile. In this connection, depending on the particular material from which the pellet 26 is constructed, the deformation point may correspond to the melting point of the material or it may correspond to the softening point of the material. In any event, the deformation point represents the point at which the pellet 26 is no longer able to apply sufficient force to the disc assembly 24 to maintain the contact element 58 in spaced relation to the fixed contact element 48. Accordingly, when the pellet 26 is exposed to the appropriate predetermined deformation temperature, it no longer applies the required amount of pressure to the disc assembly 24 so that the actuator disc 20 is resiliently returned to an undeformed disposition wherein the movable contact 58 engages the fixed contact 48.

The can or housing 28 is preferably integrally formed from a suitable metal, such as steel, in a substantially cylindrical configuration, and it has an end wall 72 having an outwardly extending projection 74 thereon which defines a recess in the interior of the can 28 for receiving the pellet 26 therein. The can 28 is dimensioned so that it is receivable in covering relation over the operative components of the latch 10, and it is secured in assembled relation on the flange 30 of the header 12, preferably by welding. The can 28 is further dimensioned so that when it is received in assembled relation on the header 12 and the pellet 26 is received in the recess defined by the projection 74, the tip portion 70 of the pellet 26 engages the communicator disc assembly 24 to deform the actuator disc 20 in order to maintain the movable contact 58 in spaced relation to the fixed contact 48. Further, the can 28 is preferably dimensioned so that it has a diameter which is only slightly greater than the diameter of the communicator disc assembly 24; and hence when the can 28 is assembled over the operative components of the latch 10, the communicator disc assembly 24 substantially isolates the pellet 26 from the contacts 48 and 58, although the actuator disc assembly 24 is nevertheless freely movable in the can 28. Accordingly, when the pellet 26 deforms upon exposure to a predetermined elevated deformation temperature, the actuator disc assembly 24 prevents the material from which the pellet 26 is constructed from interfering with the engagement of the contact element 58 with the contact element 48.

It is seen therefore that the instant invention provides an effective thermally actuated latch which is operative for closing an electrical circuit upon exposure to a predetermined elevated temperature. Specifically, when the latch 10 is exposed to a predetermined deformation temperature, the pellet 26 is deformed to a disposition of reduced profile so that it no longer presses normally applied to the actuator disc 20 adjacent the base of the movable arm 52 to enable the actuator disc 20 to be resiliently moved to an undeformed disposition wherein the movable contact 58 engages the fixed contact 48. Throughout this procedure, the communicator disc assembly 24 operates to provide communication between the pellet 26 and the actuator disc 20, but it also isolates the pellet 26 from the contact elements 58 and 48 to prevent the material from the pellet 26 from contaminating the contact elements 58 and 48. Accordingly, the operation of the latch 10 is simple and positive, and it is operative for closing or completing a circuit which is connected to the terminals 13 and 14 when the latch 10 is exposed to a predetermined elevated deformation temperature. Hence, for these reasons, it is seen that the latch of the subject invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A thermally actuated latch comprising a base made of an electrical insulating material, a housing on said base and including a wall, a fixed contact on said base, a resiliently movable contact arm, a movable contact on said arm, said arm being resiliently biased to a position wherein said movable contact engages said fixed contact, and a fusible pellet in said housing adjacent said wall, said arm being interposed between said pellet and said fixed contact, said pellet communicating with said arm to normally maintain said movable contact in spaced relation to said fixed contact, said fusible pellet being deformable upon exposure to a predetermined elevated temperature to enable said movable contact to move to a position of engagement with said fixed contact.

2. The thermally actuated latch of claim 1 further comprising fulcrum means on said base, said arm being pivotable on said fulcrum means to move said movable contact to said position of engagement with said fixed contact upon exposure of said pellet to said predetermined elevated temperature.

3. In the thermally actuated latch of claim 2, said arm being of elongated configuration, said movable contact being mounted on said arm adjacent one end thereof, said pellet communicating with said arm adjacent the opposite end thereof.

4. The thermally actuated latch of claim 1 further comprising means substantially isolating said pellet from said fixed and movable contacts.

5. In the thermally actuated latch of claim 4, said isolating means comprising a substantially rigid communicator disc, said communicator disc being received in said housing and positioned therein so that it substantially isolates said pellet from said fixed and movable contacts, said pellet communicating with said movable contact arm through said communicator disc.

6. A thermally actuated latch comprising a base made of an electrical insulating material, fulcrum means on said base, a fixed contact on said base, an actuator disc having a peripheral rim portion and a resiliently movable contact arm integrally blanked with said rim portion, said arm having a connected end and a free end, a movable contact on said arm, said arm being pivotable on said fulcrum means and being resiliently biased to a position wherein said movable contact engages said fixed contact, and deformable means communicating with said peripheral rim portion adjacent the connected end of said arm to normally maintain said movable contact in spaced relation to said fixed contact, said deformable means being fusible upon exposure to a predetermined elevated temperature to enable said arm to pivot on said fulcrum means so that said movable contact is moved to a position of engagement with said fixed contact.

7. The thermally actuated latch of claim 6 further comprising a housing and a communicator disc in said housing, said deformable means further characterized as a fusible pellet mounted in said housing, said fusible pellet communicating with said actuator disc through said communicator disc.

8. A thermally actuated latch comprising a base made of an electrical insulating material, a housing on said base and cooperating therewith to define a substantially enclosed interior chamber, a fixed contact on said base in said chamber, a resiliently movable contact arm in said chamber, a movable contact on said arm in said chamber, said arm being resiliently biased to a position wherein said movable contact engages said fixed contact, a deformable pellet in said chamber communicating with said arm to normally maintain said movable contact in spaced relation to said fixed contact, said pellet being deformable upon exposure to a predetermined elevated temperature to enable said movable contact to move to a position of engagement with said fixed contact, and means in said chamber between said pellet and said contacts substantially isolating said pellet from said fixed and movable contacts in order to prevent contamination of said contacts with material from said pellet.

* * * * *